United States Patent [19]

Barrus

[11] 4,019,100

[45] Apr. 19, 1977

[54] PRINT HAMMER ENERGIZING AND CONTROL CIRCUIT

[75] Inventor: Gordon Brent Barrus, El Segundo, Calif.

[73] Assignee: Printronix, Inc., Irvine, Calif.

[22] Filed: May 16, 1975

[21] Appl. No.: 578,179

[52] U.S. Cl. ..... 361/186; 101/93.29; 321/18; 361/187

[51] Int. Cl.[2] ..... B41J 9/38

[58] Field of Search ..... 317/151, DIG. 4; 321/18; 320/1; 323/22 SC, 25, ; 101/93.29, 93.30

[56] References Cited

UNITED STATES PATENTS

| | | | |
|---|---|---|---|
| 3,366,044 | 1/1968 | Marsh | 101/93.29 |
| 3,374,402 | 3/1968 | Derc | 317/151 |
| 3,467,005 | 9/1969 | Bernard | 101/93.29 |
| 3,589,282 | 6/1971 | King | 101/93.29 |
| 3,678,847 | 7/1972 | Pear | 317/DIG. 4 |
| 3,868,562 | 2/1975 | Marshall | 321/18 |

*Primary Examiner*—William H. Beha, Jr.
*Attorney, Agent, or Firm*—Fraser and Bogucki

[57] ABSTRACT

Control of multiple hammer elements in a high speed printing system in which the hammer elements are individually operated by energizing pulses applied to electromagnets is effected by an improved regulation circuit with which additional safety features may be used in cooperative fashion. The additive combination of a full wave rectified signal and the voltage level of a storage capacitor which is being charged by the rectified signal is sensed, converted to a lower level, and compared to a voltage reference. A silicon controlled rectifier which controls charging of the storage capacitor is turned on by this circuit only when current is beginning to flow, thus providing the equivalent of zero crossing initiation and preventing high surge currents from developing. As a further feature, signals generated during times at which printing should not be taking place, such as paper advance, are used to alter the voltage reference level so as to effectively turn off the power during the turnaround interval. The voltage reference, whether controlled in this manner or not, is also utilized to govern the coil energizing circuits, so as to prevent energization of the coils in the event of power failure, startup, shutdown and other transient operations.

10 Claims, 2 Drawing Figures

PRINT HAMMER ENERGIZING AND CONTROL CIRCUIT

BACKGROUND OF THE INVENTION

A number of electromechanical printer systems are now in use in which high speed repetitive operation of a multiplicity of hammer elements is used to control impacting at precisely timed intervals relative to a recording member. In such systems, prevention of erroneous hammer actuation and control of hammer movement are of crucial importance to print quality. In using the energization of a coil to effect printing action, it becomes highly desirable to have a regulated voltage source for supplying the multiple hammer energizing circuits, but it is of course not desirable to utilize expensive or complex circuits. It is desirable to avoid substantial power dissipation, and to protect against the generation of radio frequency interference and other noise effects in regulating the voltage. Furthermore, noise effects and transients within a system may introduce perturbations which cause erroneous hammer firings under various conditions, particularly during startup, shutdown and other intervals. It also can occur that there are various times at which it is desired to prevent possible firing of the hammers, as during paper advance intervals.

SUMMARY OF THE INVENTION

Hammer energizing and control circuits in accordance with the invention provide control of the charging of a storage capacitor from a full wave rectifier by sensing the combined voltage variation between the full wave rectified and stored charge signal levels, adjusting these to a low voltage range, and comparing the combined signal to a reference voltage of predetermined amplitude. An SCR controlling the charging of the storage capacitor with the full wave rectified power signal is consequently fired only in an initial ascending portion of the composite wave, thereby increasing the voltage level established by the storage capacitor. This arrangement is substantially free of radio frequency interference, introduces low dissipation, and controls high energy storage with adequately precise regulation.

In accordance with other features of the invention, the voltage reference itself is significantly varied so as to shut off the power during intervals in which printing is to be prohibited. In the event that a signal is present denoting a non-valid printing interval, along with sensing of a current indicating discharge of the storage capacitor, the voltage reference signal is effectively grounded so as to shut off the power. The voltage reference signal may also be used during transient conditions, such as during power failure or startup or shutdown, at which time it is also desired not to permit firing of the hammers. During these intervals, material reduction in power supply voltages for the circuits when compared with the voltage reference signal level causes energization of a separate sensing circuit which controls the provision of energizing signals to circuits which control hammer energization.

BRIEF DESCRIPTION OF THE DRAWINGS

A better understanding of the invention may be had by reference to the following description, taken in conjunction with the accompanying drawings, in which.

DETAILED DESCRIPTION

A print hammer energizing and control circuit in accordance with the invention is described as intended for cooperation with a dot matrix printer of the type disclosed and claimed in a co-pending application for patent entitled "Printer System", Gordon B. Barrus et al, Ser. No. 495,830, filed Aug. 8, 1974, now U.S. Pat. No. 3,941,051 and assigned to the assignee of the present application. As disclosed in that patent, a hammer bank having a plurality of dot printing hammers is reciprocated laterally across a printing form while individual hammers operate at high speed in each direction of movement to imprint successive dot rows for an individual span of characters. Each hammer mechanism includes an energizing coil, erroneous operation of which could cause damage to the hammer, ribbon, paper or associated elements. As described in that application also, a magnetic pickup is used in conjunction with an index wheel which is moved in synchronism with the shuttling hammer bank, to provide positional information, regularly spaced teeth on the index wheel providing reference points with a selected periodicity, except at two regions, 180° apart on the wheel, in which a wider gap demarcates the region in which the reciprocating mechanism is reversing direction, during which time the paper advance movement is effected.

Figure 1:
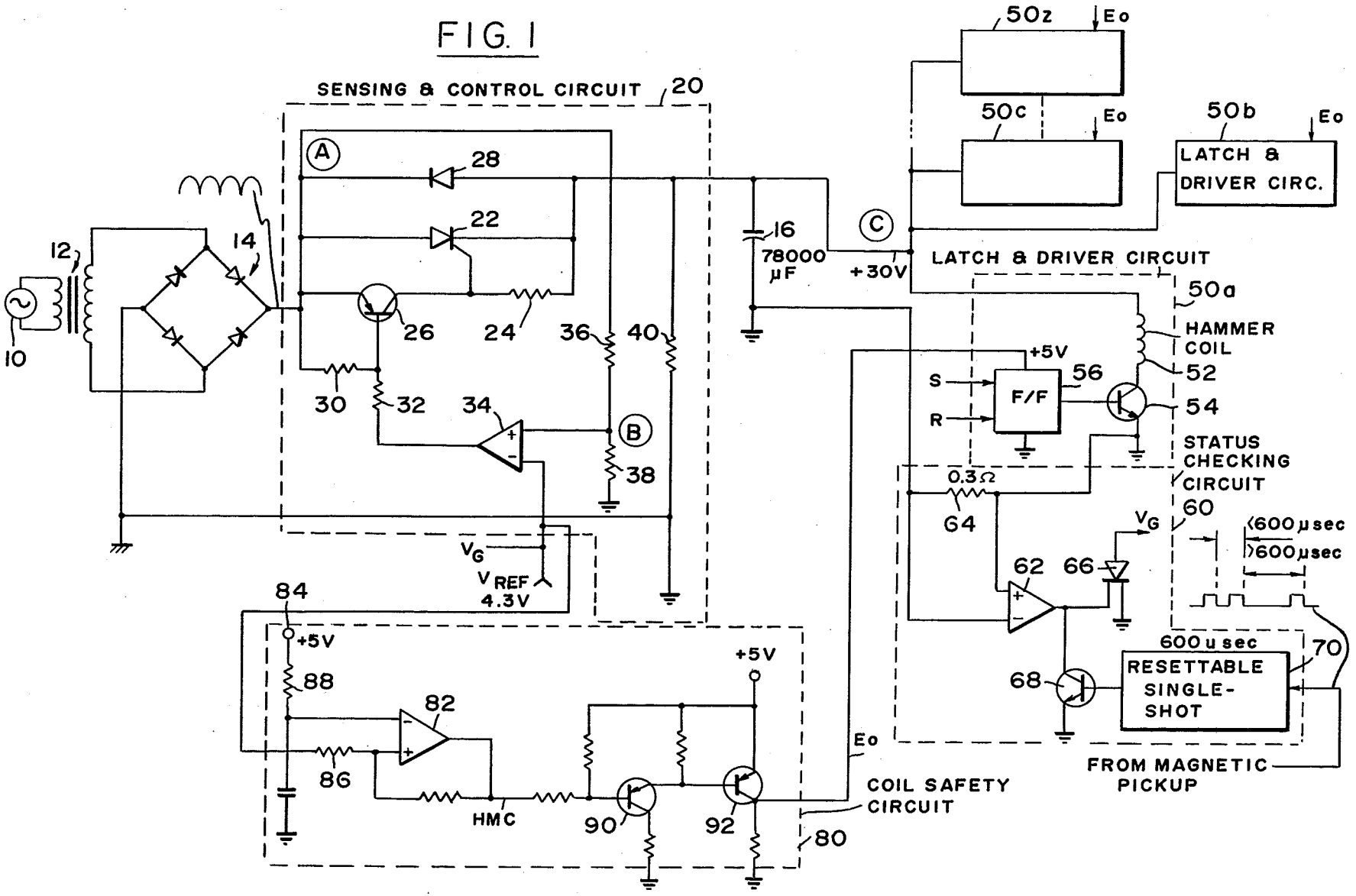
FIG. 1 is a schematic representation of circuits in accordance with the invention.

The system of FIG. 1 is specifically intended for use in this particular dot matrix printer context, but those skilled in the art will recognize its applicability to other contexts as well. In FIG. 1, a source of line voltage 10, such as a typically 60 hz supply having a nominal 120 volt level, is stepped down in voltage to an approximately 30 volt peak through a transformer 12 coupled to a full wave rectifier 14, the output terminal of which is coupled to a sensing and control circuit 20. It will be appreciated that the voltage source 10 is subject to its own voltage variations, typically within the range of 10% in excess of or 15% less than the stated voltage. It is desired to provide a regulated 30 volt DC supply of reasonable precision to the coil energizing circuits for the printer, and to this end the rectified output is provided to a very large (78,000 microfarads) capacitor 16 through the sensing and control circuit 20.

The sensing and control circuit 20 includes an SCR 22 having a feedback resistor 24 coupling its gate and cathode, and a control transistor 26 coupled to its gate. A blocking diode 28 provides a return path between the opposite terminals of the SCR 22, the cathode of the blocking diode 28 providing a junction A at which the voltages from the output of the full wave rectifier 14 and the capacitor 16 combine. Conduction of the SCR 22 is determined by the conductance state of the control transistor 26, which has a feedback resistor 30 between its emitter and base, the base receiving a control voltage through a resistor 32 from a comparator 34. The minus input of the comparator 34 receives a voltage reference, here at 4.3 volts. The plus input of the comparator 34 is coupled to the junction B of a pair of voltage divider resistors 36, 38 coupled to the junction A. A resistor 40 couples the capacitor 16 to ground to provide a discharge path for the capacitor 16 when the system is turned off.

The voltage on the capacitor 16 represents the energizing voltage for a plurality of latch and driver circuits 50a, 50b . . . 50z. Each latch and driver circuit 50 includes a hammer coil 52 which is energized by the supply voltage when a series coupled switching transistor 54 is rendered conductive by an associated flip-flop 56. In the system, SET and RESET signals applied to the flip-flop 56 which is energized by a supply voltage $E_o$, here at +5 volts, control the duration of energization of the hammer coil 52.

The emitter of the switching transistor 54 is coupled to ground, but a line from the emitter is coupled into a status checking circuit 60. The status checking circuit includes a comparator 62 which senses the current drain at the storage capacitor 16 by sensing the current through a small (.01 ohms) resistor 64 in series with the grounded terminal of the storage capacitor 16, the opposite terminals of this small resistor 64 being coupled to the separate inputs of the comparator 62. When the comparator 62 senses sufficient voltage differential across the resistor 64, it is rendered conductive. However, an SCR 66 whose control electrode is coupled to the output of the comparator 62 is rendered conductive only if a switching transistor 68 also coupled to its control electrode at a common junction with the comparator 62 is not conducting. The switching transistor 68 normally conducts because a resettable single shot multivibrator 70 is kept conducting by the recurring timing pulses provided from the index wheel in the system. Only when the timing pulses are absent for greater than a selected interval (here 600 microseconds) is the index position (the motion reversal interval occurring twice per index wheel revolution) detected. Therefore, when the resettable single shot multivibrator 70 becomes inactive, the switching transistor 68 becomes non-conductive, and the SCR 66 is fired, its anode providing a grounding signal $V_G$ for the voltage reference signal $V_{REF}$ supplied to the comparator 34 in the sensing and control circuit 20.

The system also includes a coil safety circuit 80 for generating the energizing signal $E_o$ for the flip-flops 56 in the latch and driver circuits 50, and this circuit operates in response to the $V_{REF}$ signal and the voltage of its power supply. If for any reason the power supply voltage is less than $V_{REF}$, the $E_o$ signal is terminated and the hammer coils cannot be energized. To this end, a comparator 82 compares the $V_{REF}$ signal to a signal of normally +5 volt value from a source 84, taken through different input resistors 86, 88 respectively, to provide an output signal HMC when the voltage of source 84 is greater than 4.3 volts. The presence of the HMC signal energizes a series connected pair of transistors 90, 92 energized by the +5 volt supply, and providing the $E_o$ signal for energizing the various flip-flops 56. During power failure, startup, shutdown and other transient conditions when the voltage of source 84 drops below the 4.3 v value of $V_{REF}$ the HMC signal is not produced. Consequently transistors 90 and 92 are not energized and $E_o$ is not provided. In the absence of $E_o$ the various flip-flops 56 cannot be energized and the various hammer coils 52 cannot therefore be energized.

Figure 2:
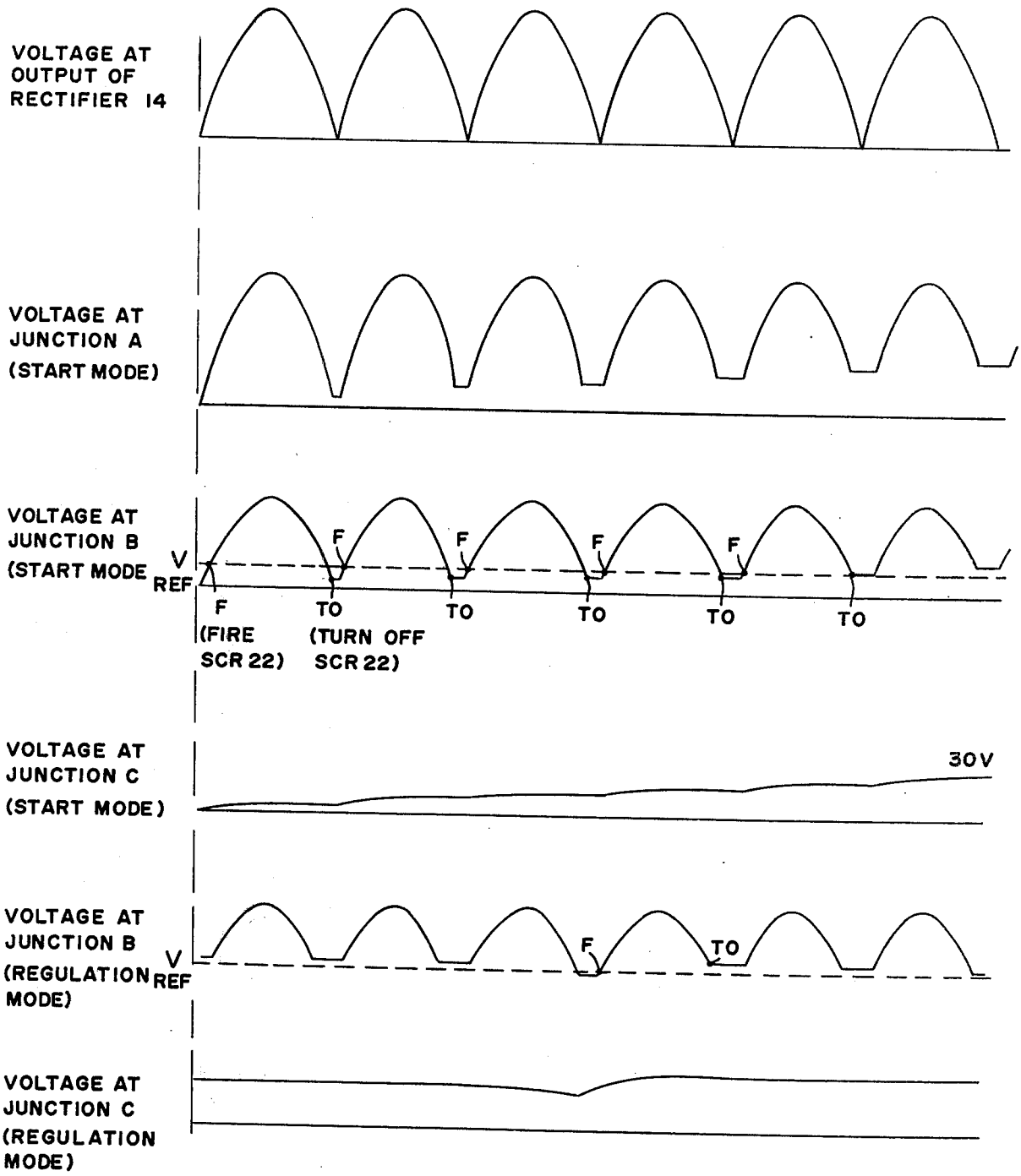
FIG. 2 is a graphical representation of waveforms occurring at different points in the circuit of FIG. 1.

The system of FIG. 1 not only provides a properly regulated high power DC signal for energizing the hammer coils, but operates in an integrated fashion to assure that the hammer coils cannot be energized under various erroneous conditions of operation. Reference should also be made to FIG. 2, in which typical waveforms occurring at different junctions in the system are depicted for different conditions. The typical full wave rectified signal at the output of the rectifier bridge 14 is applied to the SCR 22 in the sensing and control circuit 20. Assuming the startup condition in which there is no charge on the storage capacitor 16, the combined voltage is substantially zero. However, until $V_{REF}$ is applied, the minus input to the comparator 34 is also substantially zero and the switching transistor 26 is not turned on to fire the SCR 22. When $V_{REF}$ is applied to start the system, the comparator 34 causes firing of the SCR 22 each time the combined signal at junction A as reduced in voltage at junction B increases above $V_{REF}$. Once fired, the SCR 22 remains conductive until the negative-going portion of the waveform terminates in accordance with normal SCR operation. The charge on the storage capacitor 16 then begins to build toward the desired 30 volt level at a junction C, in successive increments, as shown by the corresponding waveform in FIG. 2. The combination of this signal with the full wave rectified signal at junction A gives the waveform shown in FIG. 2. At junction B, in the start mode, the SCR 22 is turned on each time the wave has a positive-going portion which begins below $V_{REF}$ and rises through the value of $V_{REF}$. Thus, the circuit automatically provides the equivalent of a zero crossing detector, firing the SCR only as it increases above the preestablished reference level set by the charge on the storage capacitor 16, and preventing the generation of substantial RFI noise.

The startup mode continues with increasing charge being built up on the storage capacitor 16 until the charge ultimately provides the desired 30 volt supply for the hammer coils 52. At this point, the junction B is at a voltage slightly greater than 4.3 volts, and until the voltage again drops below $V_{REF}$, the SCR 22 is not fired. As the hammer coils 52 are energized to drain current from the storage capacitor 16, however, the steady state component of the voltage at junction B drops down through $V_{REF}$, as shown in the curve depicting the regulation mode for this point in FIG. 2, and the comparator 34 is again turned on and the SCR 22 is fired, to again charge the capacitor 16 to a higher voltage level. This operation then continues in like fashion, and the output voltage is maintained with approximately 5% regulation in the present example, on a continuous basis. Such regulation is more than adequate for a multi-hammer system, because the high peak pulses that are needed require substantial amounts of energy but do not require a high precision source.

If there is no significant charge on the storage capacitor 16, firing of the hammer coils 52 is not feasible. On the other hand, if a sufficient voltage level is present, the hammer coils need be protected only during the turnaround interval in which the paper may be undergoing vertical movement relative to the print hammers. The status checking circuit 60 insures against erroneous operation by interrelating these factors with control of the reference voltage $V_{REF}$. Current from the charged storage capacitor 16, if the capacitor is being discharged, generates a small current in the low value resistor 64 in the status checking circuit 60, turning on the comparator 62. Except during the index interval, in which the resettable single shot multivibrator 70 is turned off, however, the switching transistor 68 is turned on, so that the output of the comparator 62 is effectively grounded and the SCR 66 is non-conductive. During the index interval the output of the comparator 62 fires the SCR 66, which effectively couples $V_{REF}$ at the input to the sensing and control circuit 20 to ground, preventing the comparator 34 from conducting and preventing the SCR 22 from firing to charge the capacitor 16.

In the coil safety circuit 80, any one of the conditions that can cause the power supply signal to be less than desired is used to prevent firing of the hammer coils 52 by disabling the flip-flops 56. The power supply signal at terminal 84 will be below 4.3 volts in the event of power failure, startup or shutdown. In each such eventuality, the comparator 82 output goes high, shutting off the normally conducting transistors 90, 92, and terminating the $E_o$ signal required to activate the flip-flops 56 and to turn the switching transistors 54 on.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An arrangement for energizing a plurality of print element circuits in a printer system comprising:

an AC source;

full wave rectifier means coupled to the AC source;

storage capacitor means coupled to energize a plurality of print element circuits;

gating means coupling the full wave rectifier means to the storage capacitor means, said gating means being operative to conduct when fired and to continue conducting for a selected period of time thereafter;

means for summing signals at the output of the full wave rectifier means and the storage capacitor means to provide a combined signal;

means for providing a reference signal; and means coupled to compare the combined signal and the reference signal, the means coupled to compare being operative to fire the gating means each time the combined signal and the reference signal assume a predetermined relationship.

2. The invention defined in claim 1, wherein the gating means comprises an SCR coupled between the full wave rectifier means and the storage capacitor means and having a gate terminal, the means for summing comprises a diode coupled in parallel with the SCR and a serial pair of resistors coupled between the diode and ground and providing the combined signal at a terminal therebetween, and the means coupled to compare comprises a comparator having a pair of inputs and an output, the pair of inputs being coupled to receive the combined signal and the reference signal, and a transistor the conduction of which is controlled by signals at the output of the comparator, the transistor being coupled to the gate terminal of the SCR.

3. The invention defined in claim 2, wherein the transistor has an emitter terminal coupled to the output of the full wave rectifier means, a collector terminal coupled to the gate terminal of the SCR and an emitter terminal coupled to the output terminal of the comparator through a first resistor, and further including a second resistor coupled between the base and emitter terminals and a third resistor coupled between the gate terminal of the SCR and the storage capacitor means.

4. An arrangement for energizing a plurality of hammer driving coils in a printer system in response to signals from an AC source comprising:

means for rectifying signals from the AC source to provide a sequence of half cycles of like polarity;

capacitor means having a variable voltage and coupled to energize the plurality of hammer driving coils;

gating means coupled between the means for rectifying and the capacitor means, said gating means being operative to conduct when fired at the beginning of a half cycle of the sequence of half cycles and to continue conducting until termination of the half cycle;

means for combining the variable voltage of the capacitor means and the sequence of half cycles to provide a combined voltage;

means providing a reference voltage; and comparator means for firing the gating means each time the combined voltage increases from a value less than the reference voltage to a value greater than the reference voltage.

5. The invention defined in claim 4, wherein the printer system provides a reversal signal when the direction of movement of a plurality of movable hammer elements therein is reversed, and further including means coupled to the capacitor means for providing a discharge signal whenever the capacitor means is discharging, and means for changing the reference voltage when the reversal signal and the discharge signal occur simultaneously.

6. The invention defined in claim 4, wherein the printer system provides a succession of signals except when a plurality of movable hammer elements therein are changing their direction of movement, and further including resettable single shot multivibrator means coupled to receive the succession of signals, resistor means coupled to the capacitor means, a second comparator having a pair of inputs coupled to opposite ends of the resistor means, and an output, a transistor arranged to selectively couple the output of the second comparator to ground in response to the multivibrator means when the multivibrator means receives the succession of signals from the printer system, and an SCR coupled between the means for providing the reference voltage and ground and having a gate terminal coupled to the output of the second comparator means.

7. The invention defined in claim 4, wherein the hammer driving coils are contained within hammer driving circuits requiring the presence of an enabling signal to permit energization of the coils, and including a power supply having a nominal voltage, second comparator means for comparing the nominal voltage of the power supply and the reference voltage, and means coupled to the second comparator means for providing the enabling signal except when the nominal voltage of the power supply and the reference voltage assume a particular relationship.

8. An arrangement for energizing a plurality of hammer driving coils in a printer system in response to signals from an AC source comprising:

a full wave rectifier bridge coupled to the AC source for providing a rectified signal;

capacitor means coupled to energize the hammer driving coils;

a device of controllable conductivity coupling the capacitor means to the rectifier bridge, conduction of the device being initiated by application of a conduction initiation signal and continuing until the rectified signal from the rectifier bridge falls below a selected value;

a common junction coupled to the rectifier bridge and the capacitor means for summing a signal representing the level of charge of the capacitor means with the rectified signal to provide a combined signal;

means providing a reference signal; and means responsive to the reference signal and the combined signal for providing a conduction initiate signal to the device of controllable conductivity each time the combined signal increases from a value less than to a value greater than the value of the reference signal.

9. In a printer arrangement in which an incoming signal is coupled to periodically charge hammer driving circuit energizing means in accordance with a comparison of a combined signal derived from the incoming signal and the level of charge of the hammer driving circuit energizing means and a reference signal, the printer arrangement providing a direction change signal each time a plurality of movable hammers therein change direction relative to a print medium, a circuit for changing the reference signal each time the movable hammers change direction comprising a device of controllable conductivity coupled to change the reference signal in response to the generation of a conduction signal, means coupled to the hammer driving circuit energizing means for normally generating the conduction signal whenever the hammer driving circuit energizing means is discharging, and means for preventing generation of the conduction signal except when the direction change signal is provided.

10. The invention defined in claim 9, wherein the device of controllable conductivity comprises an SCR having a gate terminal, the means for normally generating the conduction signal comprises resistor means coupled to the hammer driving circuit energizing means and a comparator having a pair of inputs coupled to opposite ends of the resistor means and an output coupled to the gate terminal of the SCR, and the means for preventing generation of the conduction signal comprises a transistor having emitter, collector and base terminals, the emitter and collector terminals being coupled between the gate terminal of the SCR and ground, and a resettable single shot multivibrator having an output coupled to the base terminal and an input coupled to receive the direction change signal.

* * * * *

UNITED STATES PATENT AND TRADEMARK OFFICE

CERTIFICATE OF CORRECTION

PATENT NO. : 4,019,100

DATED : April 19, 1977

INVENTOR(S) : Gordon B. Barrus

It is certified that error appears in the above-identified patent and that said Letters Patent are hereby corrected as shown below:

In the Abstract, line 4, "regulation" should read --regulating--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*